US005382024A

United States Patent [19]

Blaha

[11] Patent Number: 5,382,024

[45] Date of Patent: Jan. 17, 1995

[54] PLAYING CARD SHUFFLER AND DISPENSER

[75] Inventor: Ernst Blaha, Unter-Tullnerbach, Austria

[73] Assignee: Casinos Austria Aktienbesellschaft, Vienna, Austria

[21] Appl. No.: 122,881

[22] Filed: Sep. 15, 1993

[30] Foreign Application Priority Data

Oct. 13, 1992 [AT] Austria ..... 2011/92

[51] Int. Cl.[6] ..... A63F 1/12

[52] U.S. Cl. ..... 273/149 R

[58] Field of Search ..... 273/149 R

[56] References Cited

U.S. PATENT DOCUMENTS 4,659,082 4/1987 Greenberg ..... 273/149 R
4,770, 421 9/1988 Hoffman ..... 273/149 R

FOREIGN PATENT DOCUMENTS 136311 11/1902 Germany ..... 273/149 R
277216 12/1913 Germany ..... 273/149 R

*Primary Examiner*—Benjamin H. Layno
*Attorney, Agent, or Firm*—Collard & Roe

[57] ABSTRACT

A playing card shuffler and dispenser has a housing and a storage container for a stack of shuffled playing cards arranged in the housing, the storage container defining an output opening for consecutively discharging a single one of the playing cards from the stack. A playing card shuffling container for a stack of playing cards to be shuffled is arranged in the housing adjacent the storage container and is movable parallel and relative thereto between two end positions, the housing defining an input opening for feeding the playing cards to be shuffled into the shuffling container in one of the end positions thereof. The shuffling container is moved by a randomly operable drive between the end positions. A playing card ejector pushes a respective one of the playing cards to be shuffled from the shuffling container into the storage container, and a randomly operable drive operates the ejector.

9 Claims, 3 Drawing Sheets

PLAYING CARD SHUFFLER AND DISPENSER

BACKGROUND OF THE INVENTION

1. Field of the Invention

The present invention relates to a playing card shuffler and dispenser comprising a housing, a storage container for a stack of shuffled playing cards arranged in the housing, the storage container defining an output opening for consecutively discharging a single one of the playing cards from the stack, and a playing card shuffling container for a stack of playing cards to be shuffled, the shuffling container being adjustable relative to the storage container. A drive for adjusting the shuffling container and a drive for operating a playing card ejector for pushing a respective one of the playing cards to be shuffled from the shuffling container into the storage container are controlled by a randomly operable logic control circuit or a randomizer.

2. Description of the Prior Art

A playing card dispenser of this type has been disclosed in U.S. Pat. No. 4,659,082. In this playing card dispenser, the shuffling card container is a rotary carousel which has radially extending compartments each receiving one playing card. An input hopper holds a stack of playing cards to be shuffled which are injected into the carousel compartments and fed into an output hopper for the shuffled playing cards. The single cards are randomly ejected into the output hopper. Such a playing card dispenser attains a high degree of shuffling of the cards, and it is practically impossible to figure out the sequence of cards in the shuffled stack even if a counting system is used. However, the use of a rotary carousel requires a large space. In addition, taking the cards out of the carousel in case of a malfunction is very inconvenient and time-consuming.

SUMMARY OF THE INVENTION

It is the primary object of this invention to avoid these disadvantages in a playing card shuffler and dispenser of the first-described type, and to provide such a device which requires a minimum amount of space and which can be emptied readily in case of a malfunction so that play may be continued without delay by manually shuffling the cards.

The above and other objects of the invention are accomplished with a playing card shuffler and dispenser comprising a housing, a storage container for a stack of shuffled playing cards arranged in the housing, the storage container defining an output opening for consecutively discharging a single one of the playing cards from the stack, and a playing card shuffling container for a stack of playing cards to be shuffled, the shuffling container being arranged in the housing adjacent the storage container and being movable parallel relative thereto between two end positions. The housing defines an input opening for feeding the playing cards to be shuffled into the shuffling container in one of the end positions thereof. A randomly operable drive is provided for moving the shuffling container between the end positions, and a playing card ejector for pushing a respective one of the playing cards to be shuffled from the shuffling container into the storage container is operated by a randomly operable drive for operating the ejector.

This provides a very compact structure requiring little space. Since the individual playing cards are randomly fed from the shuffling container into the storage container, they are thoroughly and unpredictably shuffled so that the sequence of cards in the stack of shuffled cards cannot be figured out even if a counting system were used. In addition, if there is a malfunction, play may be continued with the same pack of cards, which has a considerable advantage in the operation of a casino. All that needs to be done is to take the pack of previously played cards out of the shuffling container and to shuffle them manually, whereupon the pack of shuffled cards is placed into the storage container, as is the case when the cards are played without automatic shuffling, and the individual cards are consecutively dispensed from the storage container. In this way, if the automatic shuffler malfunctions, unpleasant disputes among players can be avoided if a new pack of playing cards were used, as would be the case with the known card dispenser.

According to one preferred feature, the shuffling container comprises a bottom wall and a side wall adjacent the storage container and an end wall at a front end of the side wall, the end wall consisting of an upper plate and a lower plate defining a gap therebetween, the plates defining an ejection slot with the front end of the side wall, the ejection slot having a width corresponding substantially to the thickness of a single one of the playing cards. The playing card ejector is operable to move through the gap while being glidingly guided along the front end of the side walls for pushing the respective playing card into the storage container. This assures a secure and problem-free feeding of individual playing cards from the shuffling container into the storage container, only a single card being pushed through the ejection slot and slid into the stack of playing cards in the storage container.

The lower plate preferably has a shoulder limiting the ejection slot at the level of the bottom wall, the shoulder being convexly curved in a plane defined by the front end of the side wall whereby the respective playing card glides into the storage container along the convexly curved shoulder. This provides a defined path along which the individual playing cards are pushed from the shuffling container into the storage container.

In this connection, it is advantageous if the shuffling container has a width corresponding to the width of the playing cards and the storage container has a width corresponding to the length of the playing cards. This enables the previously played cards to be readily placed in the shuffling container since they may be placed upright therein and the shuffled cards to be readily taken out of the output opening of the storage container since they are stacked sideways therein.

For this purpose, it is useful if the ejector engages an upper end portion of each card, which causes the card to be tilted from its upright to the sideways position as it is pushed out of the shuffling container. This may be effected with an ejector which is constituted by a bell crank lever pivoted to the side wall of the shuffling container in the range of the bottom wall thereof. The bell crank lever preferably has a short arm and a longer arm, the lever being pivotally mounted at an end of the short arm near the bottom of the shuffling container. The drive for operating the ejector may comprise a crank gear. In this way, the ejector will always engage the playing card to be ejected in an upper portion thereof and will tilt the card. If a crank gear is used, the drive motor needs to be rotated only in one direction and, therefore, may be correspondingly simply constructed, which in turn simplifies the control of its operation.

According to another preferred feature, a carrier plate is connected to the shuffling container and is arranged laterally thereof at a side of the shuffling container remote from the storage container, the shuffling container end wall extending obliquely rearwardly towards the output opening. A carrier structure is affixed to the carrier plate and projects forwardly from the end wall, and the drive for operating the ejector is mounted on the carrier structure. The drive for operating the ejector preferably comprises a motor positioned substantially parallel to the obliquely extending mixing container end wall, a bevel gear driven by the motor, a crank disc driven by the bevel gear, and a connecting rod connecting the crank disc with the ejector. This provides a very simple construction, and the orientation of the motor parallel to the oblique end wall of the shuffling container reduces the length of the playing card mixer and dispenser.

According to yet another preferred embodiment, the drive for moving the shuffling container comprises a clamping device at a side of the carrier plate facing away from the shuffling container, a toothed belt mounted to revolve laterally of the carrier plate and the clamping device being clamped to a stringer of the toothed belt, a motor, a sprocket driven by the motor, the toothed belt being trained over the sprocket and a guide pulley, guides engaging the carrier plate and guiding the same, and the toothed belt stringer extending substantially parallel to the guides. This assures a secure entrainment of the shuffling container so that a separate monitoring of the position of the shuffling container relative to the storage container may be avoided, particularly if the drive for moving the shuffling container comprises a stepping motor.

BRIEF DESCRIPTION OF THE DRAWING

The above and other objects, advantages and features of the invention will become more apparent from the following detailed description of certain now preferred embodiments thereof, taken in conjunction with the accompanying drawing wherein FIG. 1 schematically illustrates one embodiment of the playing card shuffler and dispenser, in a perspective view, with parts partially broken away to show mechanism inside the housing.

DETAILED DESCRIPTION OF PREFERRED EMBODIMENTS

Figure 1:
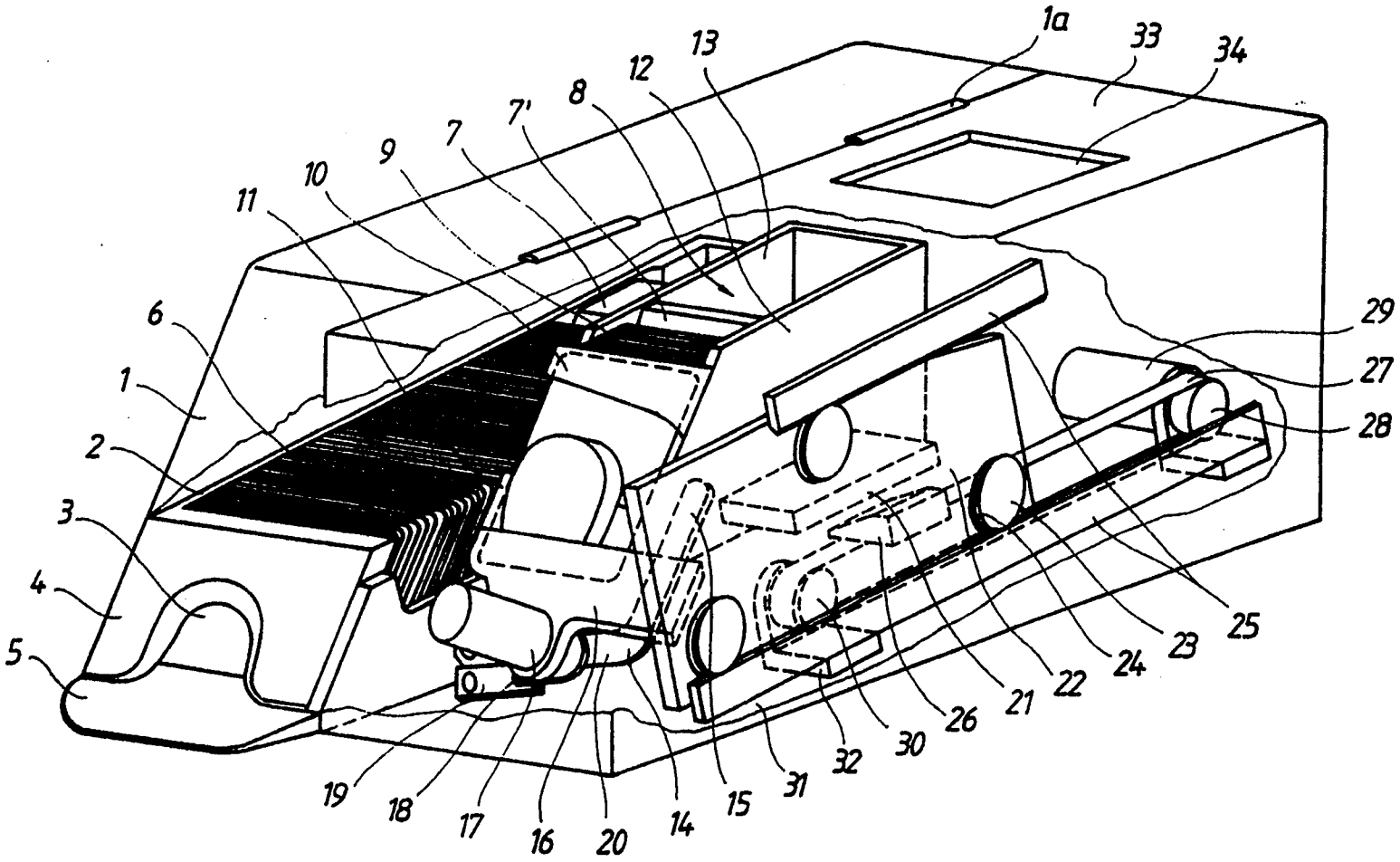

In the drawing, like reference numerals designate like parts functioning in a like manner in all figures.

Referring now to FIG. 1, there is shown a playing card shuffler and dispenser comprising housing 1. Obliquely rising storage container 2 for stack 6 of shuffled playing cards is arranged in housing 1, the storage container defining output opening 3 in front wall 4 of the storage container for consecutively discharging a single one of the playing cards from stack 6 through a slot defined between bottom 5 of the storage container and a lower edge of the front wall.

Card shoe 7 in storage container 2 exerts a steady pressure on stack 6 of the shuffled playing cards against the inside of front wall 4. The card shoe is of a form similar to a box and covers a roller which is rotatably held in the side walls of the card shoe and is made of a relatively heavy material, such as steel. Thus, because of the slope of bottom 5 of the storage container, card shoe 7 tends to glide on the roller towards front wall 4 against the stack of shuffled playing cards in the storage container.

Illustrated housing 1 is comprised of two parts connected by hinges 1*a*, one housing part containing storage container 2 and the other housing part containing playing card shuffling container 8 for stack 9 of playing cards to be shuffled. The shuffling container is arranged in the housing adjacent the storage container and is movable parallel and relative thereto in a longitudinal direction between two end positions. For ready access to shuffling container 8, the other housing part may be readily lifted by pivoting it upwards at hinges 1*a*. Housing cover 33 defines input opening 34 for feeding the previously played playing cards to be shuffled into shuffling container 8 in one of the end positions thereof. A logic control circuit (not shown and optionally of a type fully described and illustrated in U.S. Pat. No. 4,659,082) randomly operates a drive for moving the shuffling container between the end positions. Playing card ejector 14 pushes a respective one of the playing cards to be shuffled from shuffling container 8 into storage container 2, and the logic control circuit randomly operates a drive for operating ejector 14

The illustrated shuffling container comprises bottom wall 42, side wall 13 adjacent storage container 2 and an end wall at a front end of the side wall, the end wall consisting of upper plate 10 and lower plate 11 defining a gap therebetween. End wall plates 10, 11 engage the front end of side wall 12 of the shuffling container remote from storage container 2 and define ejection slot 41 (shown in FIG. 2) with the front end of side wall 13, the ejection slot having a width corresponding substantially to the thickness of a single one of the playing cards, and playing card ejector 14 being operable to move through the gap while being glidingly guided along the front end of the side wall of pushing the respective playing card into the storage container. Card shoe 7' (similar to card shoe 7) is arranged in shuffling container 8 to press stack 9 of the playing cards to be shuffled against end wall plates 10, 11.

As shown, shuffling container 8 has a width corresponding to the width of the playing cards and storage container 2 has a width corresponding to the length of the playing cards so that the cards are held in upright position in the shuffling container and in sideways position in the storage container. The foremost card in stack 9 is pushed into stack 6 in storage container 2 by ejector 14 while being tilted from its upright position in the shuffling container to the sideways position in the storage container, as shown in phantom lines in FIG. 3.

Figure 3:
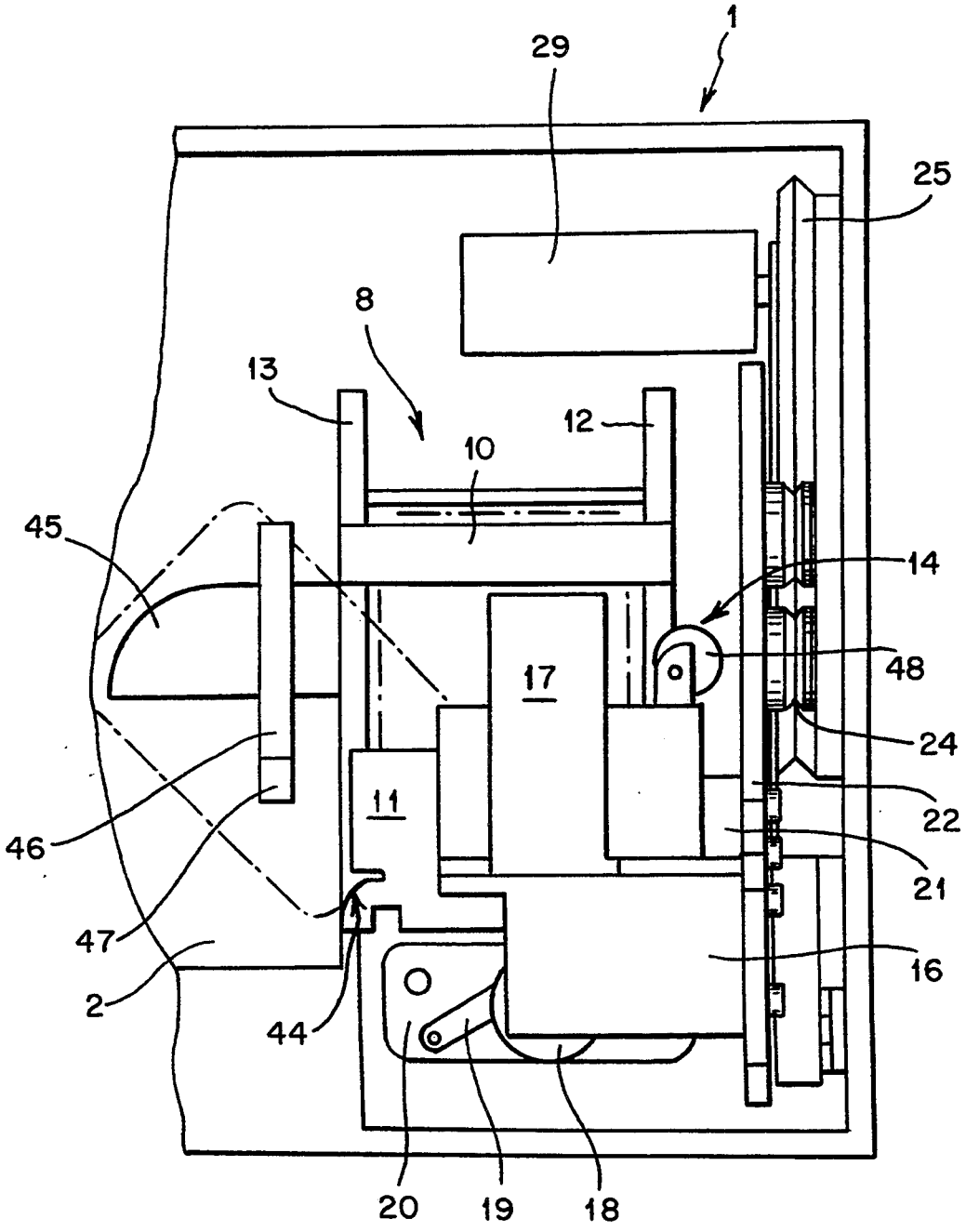
FIG. 3 is a fragmentary end view of the shuffling container front end shown in FIG. 2.

As illustrated in FIG. 3, lower end wall plate 11 has shoulder 44 limiting ejection slot 41 at the level of bottom wall 42, the shoulder being convexly curved in a plane defined by the front end of side wall 13 whereby the respective playing card glides into storage container 2 along the convexly curved shoulder.

The illustrated ejector is a bell crank lever having short arm 20 and longer arm 15, the lever being pivotally mounted at a thickened end of the short arm in the range of bottom 42 of the front end of shuffling container 8 and the longer bell crank lever arm having a free end movable into the gap between end wall plates 10, 11 to push the foremost card of stack 9 into storage container 2 while tilting it. The illustrated drive for operating ejector 14 comprises crank gear 37.

Figure 2:
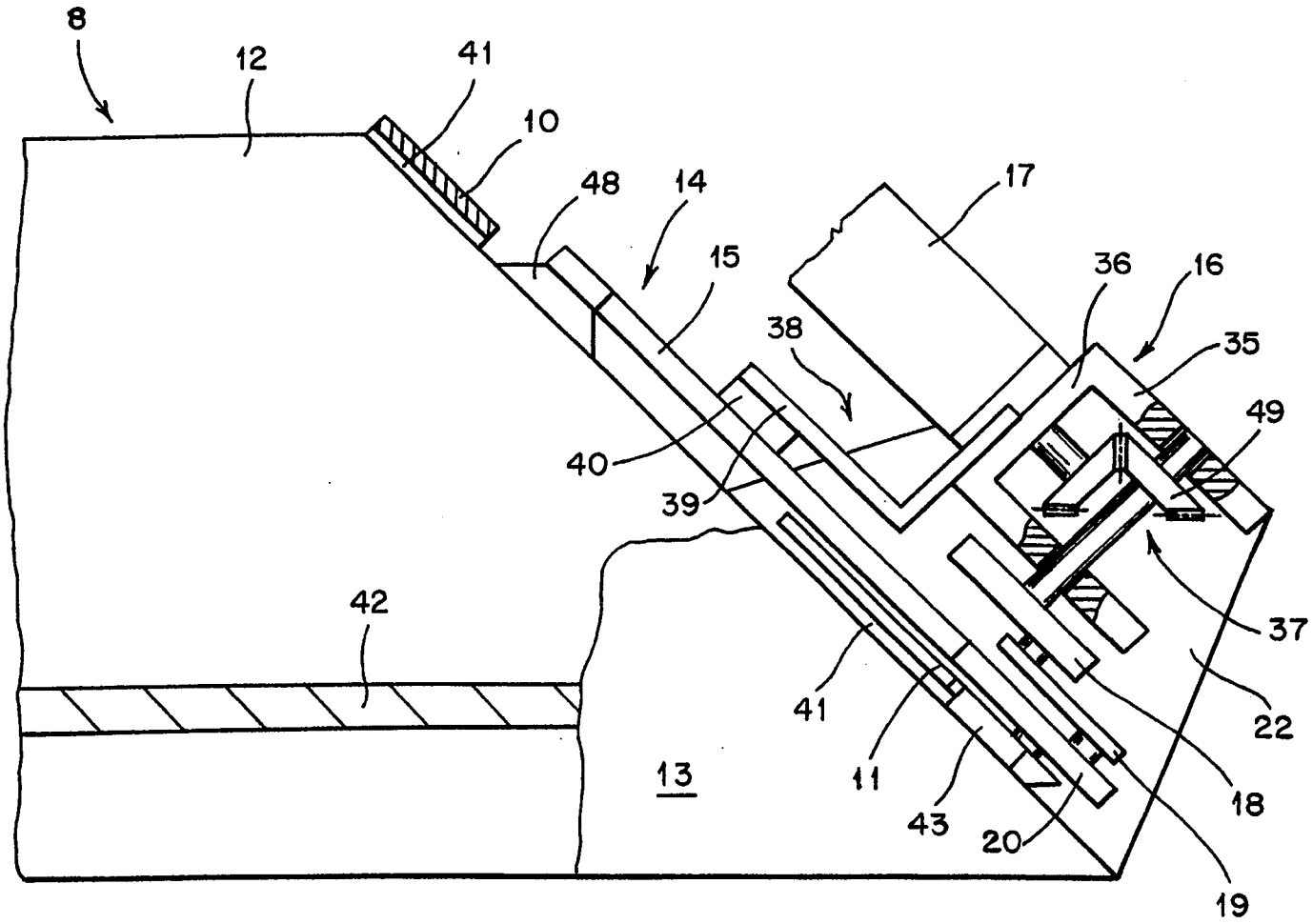
FIG. 2 is a fragmentary side view showing the front end of another embodiment of the shuffling container of the playing card shuffler and dispenser.

The illustrated playing card shuffler and dispenser further comprises carrier plate 22 affixed to shuffling container 8 by connecting piece 21 and arranged laterally thereof at a side of the shuffling container remote from storage container 2. As best shown in FIG. 2, the shuffling container end wall extends obliquely rearwardly towards output opening 34 and carrier structure 16 is affixed to the carrier plate and projects forwardly from the end wall.

The drive for operating ejector 14 is mounted on carrier structure 16. It comprises motor 17 positioned substantially parallel to the obliquely extending shuffling container end wall, bevel gear 49 driven by the motor, crank disc 18 driven by the bevel gear, and connecting rod 19 connecting the crank disc with the ejector.

In the embodiment shown in FIG. 1, carrier plate 22 carries three freely rotatable rollers 23 defining peripheral V-shaped grooves 24 which engage knife edges of guide rails 25 mounted on a side wall of housing 1. The guide rails run substantially parallel to bottom 5 of storage container 2 so that shuffling container 8, to which carrier plate 22 is attached, is guided parallel to the storage container. The drive for moving shuffling container 8 along guide rails 25 comprises clamping device 26 at a side of the carrier plate facing away from the shuffling container and affixed thereto, toothed belt 27 mounted to revolve laterally of the carrier plate, the toothed belt being trained over drive sprocket 28 and pulley 30 mounted on bracket 32 on bottom 31 of housing 1. The clamping device is clamped to a stringer of toothed belt 27, and the drive further comprises motor 29 and sprocket 28 driven by the motor.

Instead of the illustrated drive for moving shuffling container 8 parallel to storage container 2, this drive may comprise a threaded spindle driven by motor 29 and a nut displaceable along the spindle upon rotation thereof and affixed to the shuffling container so that the same is moved when the spindle is rotated. With such a drive, no guide rails are required since the threaded spindle provides the guide means.

Drive motors 17 and 29 for operating ejector 14 and moving shuffling container 8, respectively, are controlled for random operation by a logic controller (not shown) so that the shuffling container is constantly reciprocated between two end positions and is randomly stopped therebetween to operate ejector 14. In this manner, randomly selected cards at the randomly selected stops will be pushed by ejector 14 from stack 9 of the playing cards to be shuffled and will be inserted in stack 6 of the shuffled playing cards in storage container 2. The control circuit may be so arranged that the logic controller directly controls motor 29 for moving shuffling container 8 and stopping it at randomly selected points, whereupon motor 17 is actuated to eject a playing card from the shuffling into the storage container and motor 29 again moves the shuffling container. This unpredictable random selection of each ejected playing card makes it impossible to figure out the sequence of cards in stack 6 even with sophisticated counting methods.

In operation, the playing cards are shuffled in the following manner:

In the rear end position of shuffling container 8 (shown in FIG. 1), previously played cards are inserted in an upright position into the shuffling container through opening 34 in cover 33 of housing 1. Thereupon, motor 29 is started to move the shuffling container several times back and forth along storage container 2, individual playing cards at random stops being pushed by the operation of ejector 14 from stack 9 into stack 6 while being tilted from their upright position in shuffling container 8 to their sideways position in storage container 2.

In the embodiment illustrated in FIGS. 2 and 3, carrier structure 16 has a U-shaped profile, arms 35 of this structure extending substantially parallel to the obliquely extending front ends of side walls 12, 13 of shuffling container 8 while motor 17 is mounted on connecting web 36 of the U-shaped carrier structure. This construction enables the length of shuffling container 8 with ejector operating motor 17 to be reduced. Cam disc 18 is driven by cam gear 37 which is constituted by bevel gears 49.

Furthermore, web 36 of carrier structure 16 carries angle iron 38 whose upright arm 39 is equipped with glide bearing 40 wherealong longer arm 15 of ejector 14 glides when it is pivoted for pushing a playing card through slot 41. Angle iron 38 serves to hold down and guide ejector 14 during its operation to assure that the ejector engages the foremost playing card of stack 9 and ejects the same from this stack and injects it in stack 6. FIG. 2 clearly shows slot 41 defined between end wall plates 10, 11 of shuffling container 8 and the front end of shuffling container side wall 13.

As FIGS. 2 and 3 illustrate, thickened attachment 43 of lower end wall plate 11 engages the front end of bottom 42 of shuffling container 8 and is convexly rounded at 44 at the side facing ejection slot 41 so that (as shown in phantom lines) the ejected playing car glides over the convexly curved end of thickened end wall plate attachment 43 and is tilted into playing card stack 6 in storage container 2. Since frusto-conical head 48 of ejector 14 engages an upper portion of the ejected playing card during the entire pivotal movement of the ejector while the lower card portion is frictionally held in stack 9 because of the pressure exerted thereupon by card shoe 7', the card is tilted during ejection.

In the embodiment of FIGS. 2 and 3, L-shaped carrier 45 is mounted on side wall 13 of shuffling container 8 and carries pressure element 46 which presses the shuffled playing cards in stack 6 against bottom 5 of storage container 2 when shuffling container 8 is moved back and forth along the storage container. The pressure element is removably mounted on carrier 45 and has a bent front end 47 which facilitates its moving over projecting cards in the stack. Bent front end 47 of pressure element 46 will press such projecting cards into stack 6 against bottom 5 of storage container 2.

What is claimed is:

1. A playing card shuffler and dispenser comprising (a) a housing, (b) a storage container for a stack of shuffled playing cards arranged in the housing, the storage container defining (1) an output opening for consecutively discharging a single one of the playing cards from the stack, (c) a playing card shuffling container for a stack of playing cards to be shuffled, the shuffling container being arranged in the housing adjacent the storage container and being movable parallel and relative thereto between two end positions, (1) the housing defining an input opening for feeding the playing cards to be shuffled into the shuffling container in one of the end positions thereof, and the shuffling container comprising (2) a,bottom wall, (3) a side wall adjacent the storage container and (4) an end wall at a front end of the side wall, the end wall consisting of an upper plate and a lower plate defining a gap therebetween, the plates defining an ejection slot with the front end of the side wall, the ejection slot having a width corresponding substantially to the thickness of a single one of the playing cards, (d) a randomly operable drive for moving the shuffling container between the end positions, (e) a playing card ejector for pushing a respective one of the playing cards to be shuffled from the shuffling container into the storage container, the playing card ejector being operable to move through the gap while being glidingly guided along the front end of the side wall for pushing the respective playing card into the storage container, and (f) a randomly operable drive for operating the ejector.

2. The playing card shuffler and dispenser of claim 1, wherein the lower plate has a shoulder limiting the ejection slot at the level of the bottom wall, the shoulder being convexly curved in a plane defined by the front end of the side wall whereby the respective playing card glides into the storage container along the convexly curved shoulder.

3. The playing card shuffler and dispenser of claim 1, wherein the ejector is a bell crank lever pivotally mounted in the range of the bottom wall thereof.

4. The playing card shuffler and dispenser of claim 3, wherein the bell crank lever has a short arm and a longer arm, the lever being pivoted at an end of the short arm.

5. The playing card shuffler and dispenser of claim 3, wherein the drive for operating the ejector comprises a crank gear.

6. The playing card shuffler and dispenser of claim 1, further comprising a carrier plate affixed to the shuffling container and arranged laterally thereof at a side of the shuffling container remote from the storage container, the shuffling container end wall extending obliquely rearwardly towards the output opening, a carrier structure affixed to the carrier plate and projecting forwardly from the end wall, and the drive for operating the ejector being mounted on the carrier structure.

7. The playing card shuffler and dispenser of claim 6, wherein the drive for operating the ejector comprises a motor positioned substantially parallel to the obliquely extending shuffling container end wall, a bevel gear driven by the motor, a crank disc driven by the bevel gear, and a connecting rod connecting the crank disc with the ejector.

8. The playing card shuffler and dispenser of claim 6, wherein the drive for moving the shuffling container comprises a clamping device at a side of the carrier plate facing away from the shuffling container, a toothed belt mounted to revolve laterally of the carrier plate and the clamping device being clamped to a stringer of the toothed belt, a motor, a sprocket driven by the motor, the toothed belt being trained over the sprocket and a guide pulley, guides engaging the carrier plate and guiding the same, and the toothed belt stringer extending substantially parallel to the guides.

9. The playing card shuffler and dispenser of claim 1, wherein the playing cards have a width and a length, the shuffling container having a width corresponding to the width of the playing cards and the storage container having a width corresponding to the length of the playing cards.

* * * * *